US007516745B2

(12) United States Patent
Maione et al.

(10) Patent No.: US 7,516,745 B2
(45) Date of Patent: Apr. 14, 2009

(54) HEAT DELIVERY SYSTEM FOR HEATED HAIR ROLLERS/CURLERS AND CLIPS

(75) Inventors: Mario Maione, Monroe, CT (US); John Wilcox, Newport, RI (US)

(73) Assignee: Rovcal, Inc., Madison, WI (US)

( * ) Notice: Subject to any disclaimer, the term of this patent is extended or adjusted under 35 U.S.C. 154(b) by 448 days.

(21) Appl. No.: 10/927,224

(22) Filed: Aug. 25, 2004

(65) Prior Publication Data

US 2005/0056297 A1 Mar. 17, 2005

Related U.S. Application Data

(60) Provisional application No. 60/503,294, filed on Sep. 15, 2003.

(51) Int. Cl.
*A45D 4/18* (2006.01)
*A45D 4/16* (2006.01)
*A45D 4/00* (2006.01)

(52) U.S. Cl. ..... 132/231; 132/233; 132/229

(58) Field of Classification Search ..... 132/231, 132/223, 226, 245, 250, 252, 269, 229, 233
See application file for complete search history.

(56) References Cited

U.S. PATENT DOCUMENTS

| | | | | | |
|---|---|---|---|---|---|
| 3,515,851 | A | | 6/1970 | D'Elia et al. | |
| 3,600,552 | A | | 8/1971 | Tolmie | |
| 3,610,878 | A | | 10/1971 | Thomas et al. | |
| 3,766,930 | A | * | 10/1973 | Madsen et al. | 132/233 |
| 4,190,065 | A | | 2/1980 | Kulpa | |
| 4,214,597 | A | | 7/1980 | Glassman | |
| 4,293,760 | A | | 10/1981 | Smal | |
| 4,569,360 | A | * | 2/1986 | Glucksman | 132/226 |
| 4,576,188 | A | * | 3/1986 | Barradas | 132/226 |
| 4,984,591 | A | | 1/1991 | Jacobi | |
| 5,000,201 | A | * | 3/1991 | Barradas | 132/260 |
| D332,155 | S | * | 12/1992 | Wistrand | D28/38 |
| 5,220,931 | A | | 6/1993 | Aida | |
| 5,981,908 | A | | 11/1999 | McGuire et al. | |
| 6,114,661 | A | | 9/2000 | Leung | |
| 6,408,858 | B1 | | 6/2002 | Emmons et al. | |
| 6,499,195 | B1 | | 12/2002 | Wong | |

OTHER PUBLICATIONS

International Search Report for PCT/US04/28472 dated Aug. 17, 2005, 2 pages.

* cited by examiner

*Primary Examiner*—Robyn Doan
(74) *Attorney, Agent, or Firm*—Armstrong Teasdale, LLP

(57) ABSTRACT

By providing a hair curler/roller which comprises a unique, distinctive construction that enables the hair roller/curler to be heated substantially more rapidly than prior art constructions, an easily used, hair curler/roller and heating system is obtained which is capable of providing rapid heating of the hair curler/roller. In addition, the heating system employed for transferring heat to the hair curler/roller is also constructed in a unique manner that optimizes heat transfer, while also being constructed efficiently and inexpensively.

In accordance with the present invention, the hair curler/roller incorporates an elongated cylindrically shaped body or core formed from heat retaining metal, such as aluminum. In addition, the cylindrical body incorporates a plurality of thin, interconnected wall members peripherally surrounded by a cylindrical outer wall. Preferably, the unique metal core is easily manufactured by extrusion, thereby achieving a hair roller/curler which is easily constructed as well as capable of absorbing and retaining heat rapidly and efficiently.

22 Claims, 5 Drawing Sheets

FIG. 1
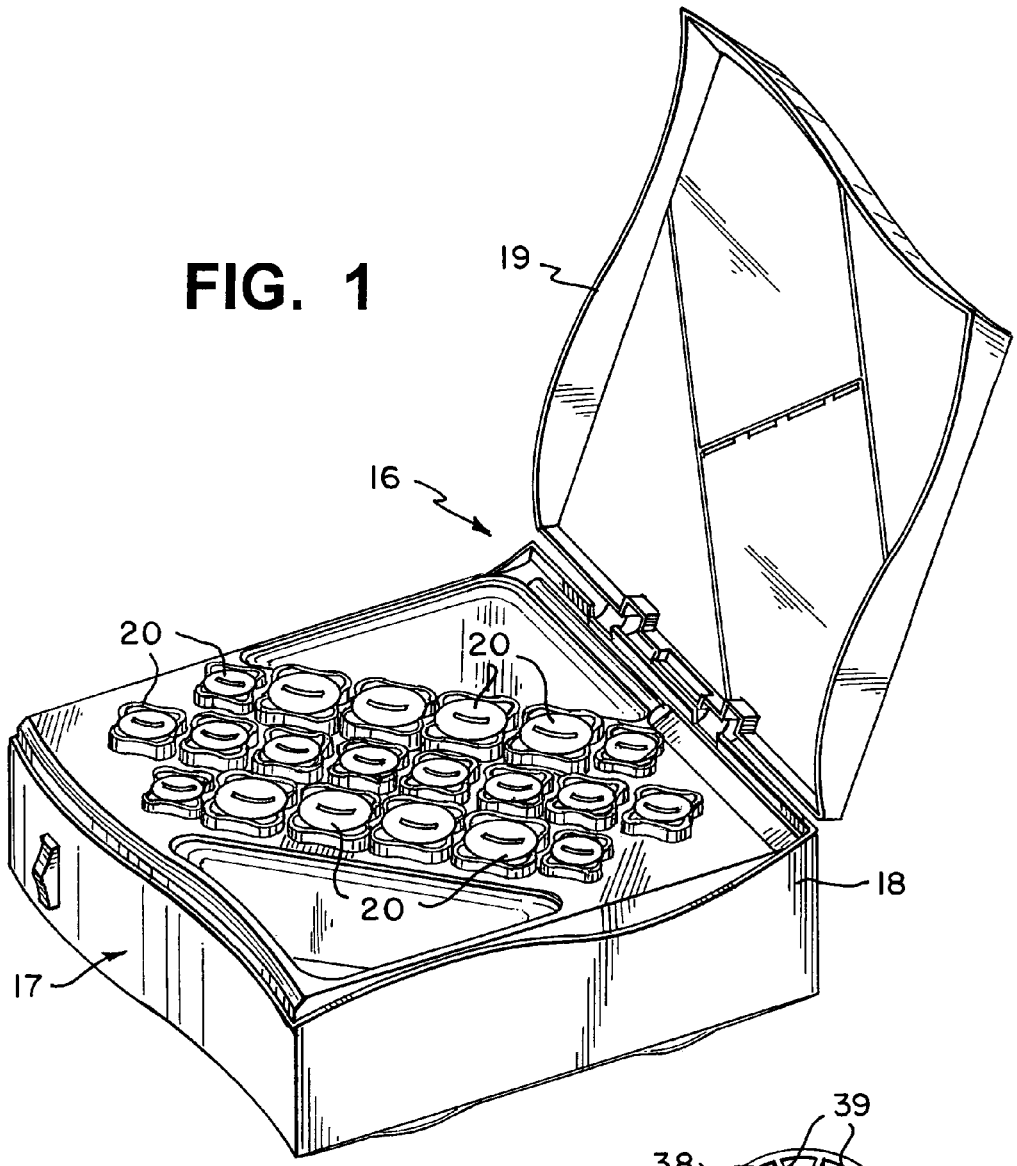
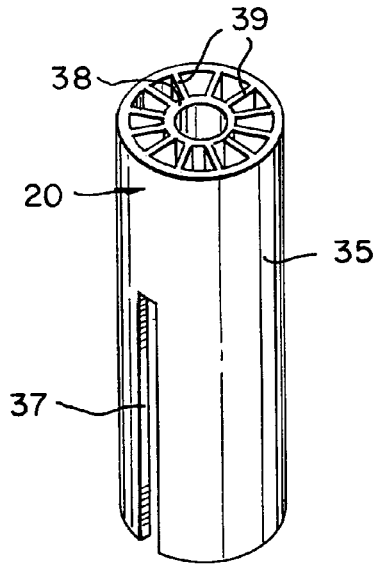
FIG. 4

FIG. 2
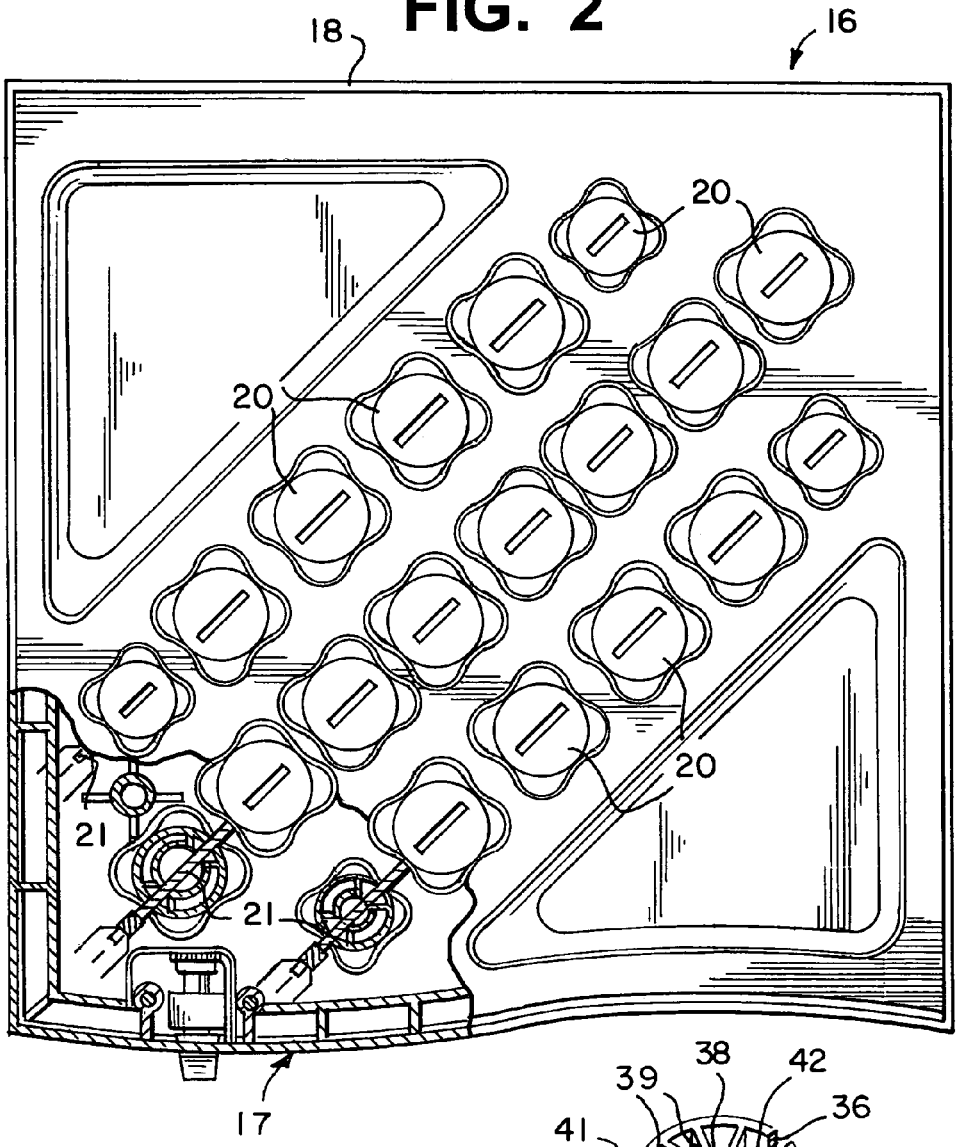
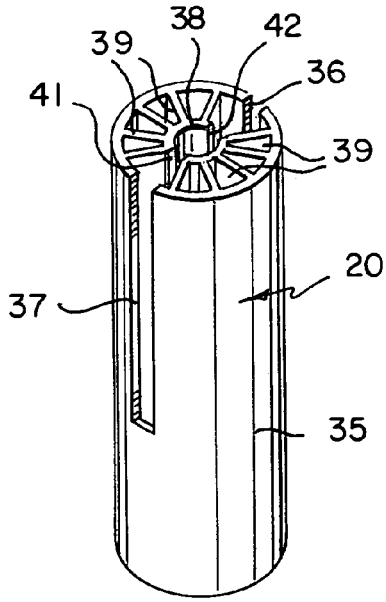
FIG. 5

FIG. 3
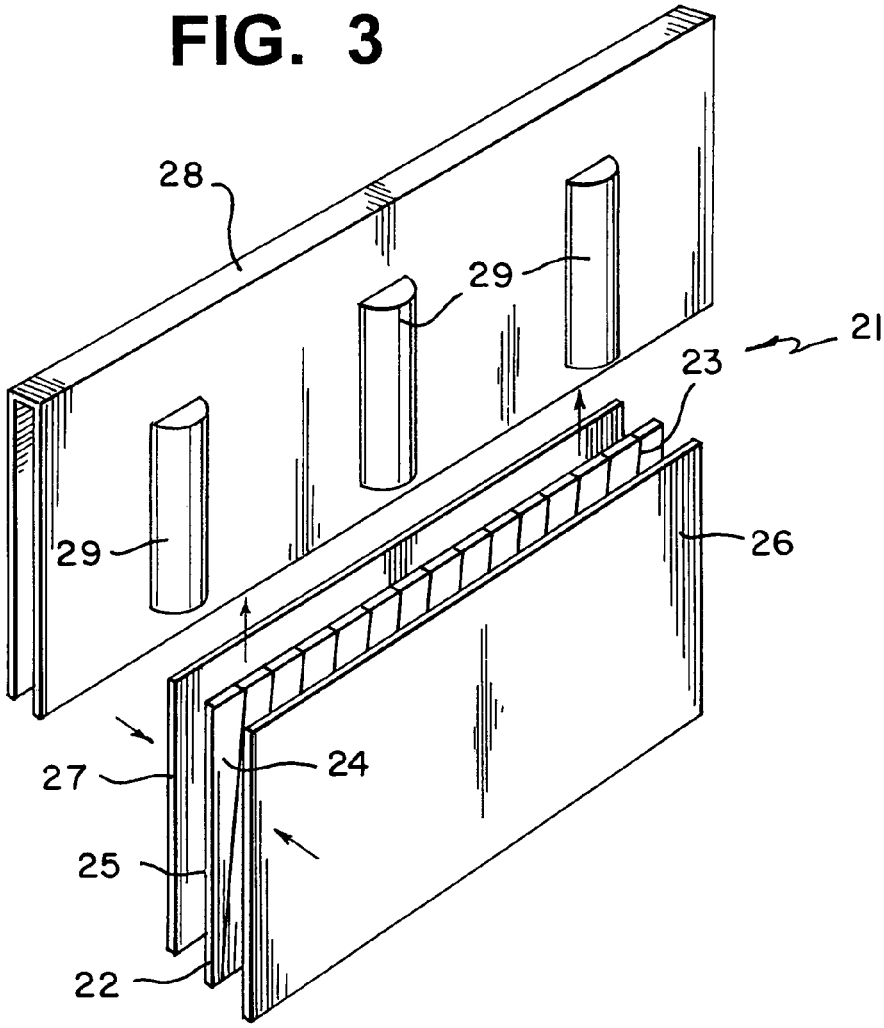
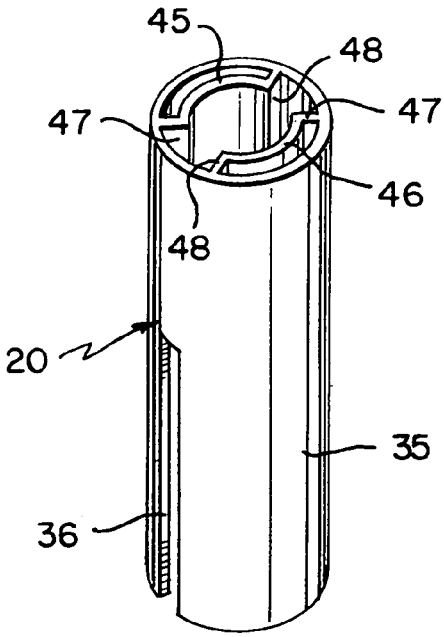
FIG. 6

HEAT DELIVERY SYSTEM FOR HEATED HAIR ROLLERS/CURLERS AND CLIPS

RELATED DATA

This application is related to U.S. Provisional Patent Application Ser. No. 60/503,294, filed Sep. 15, 2003 entitled Heat Delivery System for Heated Hair Rollers/Curlers and Clips.

TECHNICAL FIELD

This invention relates to heated hair curler assemblies and, more particularly, to a fast heating hair curler assembly and hair curler constructions therefor.

BACKGROUND ART

In attempting to satisfy the wide variety of demands and desires of consumers for different hair styles and different hair curls and/or waves, a wide variety of hair curler configurations and hair roller constructions, as well as heating systems therefore, have been developed and made available. However, in spite of this interest and the products which have been made available, these prior art constructions have been incapable of satisfying all of the needs and desires of most consumers.

In particular, consumers wishing to employ heated hair rollers or curlers seek to have hair curlers heated virtually instantaneously, in order to satisfy the typical busy schedule facing most users. As a result, prior art heated hair roller systems have attempted to provide rapid heating of the hair rollers for use by the consumer. However, these prior art systems have been incapable of satisfying the speed with which consumers desire to have the hair roller heated due to the inherent construction typically employed in such prior art products.

In addition, consumers desire to have optimal performance by the heated hair rollers while also expecting all associated clips or holders to be easily usable and mountable to the hair roller. Furthermore, in order to assure the rapid transfer of heat to hair, most consumers also wish to have the hair clips heated along with the roller. In spite of these desires, prior art systems have generally been incapable of satisfying these additional requirements.

Therefore, it is a principal object to the present invention to provide a hair roller or curler and a heating system therefore which is capable of providing rapid and efficient heating of the hair curler/roller.

Another object of the present invention is to provide a hair roller or curler and heating system therefore having the characteristic features described above which is capable of being easily used by the consumer for achieving a wide variety of hair styles and curl configurations.

Another object of the present invention is to provide a hair roller or curler and heating system therefore having the characteristic features described above which is also capable of heating hair clips simultaneously with the hair roller/curler, thereby enabling maximum heat transfer to the hair fibers.

Other and more specific objects will in part be obvious and will in part appear hereinafter.

SUMMARY OF THE INVENTION

By employing the teaching of the present invention, all of the difficulties and drawbacks found in conventional prior art hair curlers/rollers and heating systems therefore are eliminated, and an easily used, hair curler/roller and heating system is obtained which is capable of providing rapid heating of the hair curler/roller. In addition, the hair curler/roller and heating system of the present invention is capable of being manufactured substantially more economically than prior art constructions. As a result, added benefits and enhanced performance are realized by the consumer.

In order to overcome the prior art drawbacks and inabilities, one of the features of the present invention is the hair curler/roller employed which comprises a unique, distinctive construction that enables the hair roller/curler to be heated substantially more rapidly than prior art constructions. In addition, the heating system employed for transferring heat to the hair curler/roller is also constructed in a unique manner that optimizes heat transfer, while also being constructed efficiently and inexpensively.

In order to achieve a hair curler/roller which is capable of being quickly heated to any desired temperature, the hair curler/roller of the present invention incorporates an elongated cylindrically shaped body or core formed from heat retaining metal, such as aluminum. In addition, the cylindrical body incorporates a plurality of thin, interconnected wall members peripherally surrounded by a cylindrical outer wall. Preferably, the unique metal core is easily manufactured by extrusion, thereby achieving a hair roller/curler which is easily constructed as well as capable of absorbing arid retaining heat rapidly and efficiently.

In constructing the heat transfer member of the present invention, an easily manufactured, elongated, heating rail is employed which is constructed for optimizing the production of heat and the transfer of the heat directly to a hair roller/curler. In the preferred construction, a heating wire is wrapped about a mica board for producing the desired level of heat, with the heating wire surrounded by additional layers of mica board for insulating the heating wire while enabling efficient heat transfer. Finally, the entire assembly is completed by surrounding the rail construction with elongated thin sheets of metal for further enhancing the heat transfer.

In one preferred embodiment of the present invention, each of the hair rollers/curlers incorporates a slot formed therein which enables the hair roller/curler to be positioned directly on the heating rail substantially perpendicularly to the length of the rail. In addition, in this embodiment, the hair roller/curler preferably comprises an arcuately curved, longitudinally extending, cylindrically shaped, central tube portion, which extends substantially the entire length of the hair curler/roller. In this embodiment, a plurality of radially extending fins interconnect the central tube member with the outer cylindrical surface of the hair curler/roller. In this way, an efficient heat absorbing, easily manufactured hair curler/roller construction is realized.

In addition, in order to optimize the transfer of heat from the rail to the hair curler/roller, the metal surface of the rail preferably comprises a plurality of spaced, arcuately curved, post-forming portions embossed thereon. Preferably, the post-forming portions are constructed and positioned for mating, aligned engagement with the arcuately curved central tube portion of each hair curler/roller, thereby enhancing and optimizing the direct heat transfer from the rail to the hair curler/roller.

In an alternate embodiment of the present-invention, each hair curler/roller incorporates an elongated, longitudinally-extending, rail engaging slot formed in the side of the hair curler/roller and extending the entire length of the hair curler/roller. By employing this construction, the hair curler/roller is positioned on the heating rail with the longitudinal, central axis of the hair curler/roller being parallel to the length of the heating rail.

By employing this embodiment of the present invention, it has been found that arcuately curved hair retaining clips are easily positioned directly on the hair curler/rollers during the heating cycle, enabling the hair clips to be heated simultaneously with the hair curler/rollers. In this way, substantially enhanced beneficial results in optimal heating capabilities are attained.

The invention accordingly comprises the features of construction, combination of elements and arrangement of parts which will be exemplified in the constructions hereinafter set forth, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a perspective view of one embodiment of a fast heating hair curler assembly of the present invention;

FIG. 2 is a top plan view of the fast heating hair curler assembly of FIG. 1;

FIG. 3 is an exploded perspective view of one embodiment of a heat delivery rail forming a component of the fast heating hair curler assembly illustrated in FIGS. 1 and 2;

FIG. 4 is a top perspective view of one embodiment of a hair curler/roller of the present invention;

FIG. 5 is a bottom perspective view of the hair curler/roller of FIG. 4;

FIG. 6 is a top perspective view of another embodiment of a hair curler/roller of the present invention;

DETAILED DESCRIPTION

Figure 7:
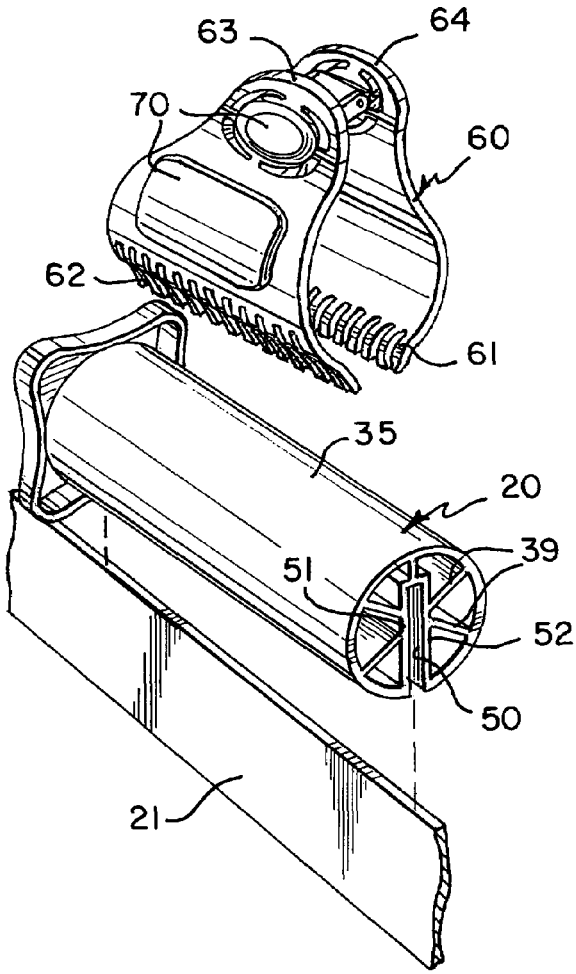
FIG. 7 is an exploded perspective view of another embodiment of a hair curler/roller of the present invention and a cooperating hair clip.

By referring to FIGS. 1-10, along with the following detailed disclosure, the construction, operation, and use of the two preferred embodiments of the fast heating hair curler assemblies 18 of the present invention can best be understood. In addition, these figures and the following detailed discussion also fully disclose the preferred construction of heat delivery support rails 21 and heated hair curlers/rollers 20 of the present invention. As is evident from this disclosure, the present invention may be manufactured using further alternate constructions. Consequently, it is to be understood that the embodiments detailed herein are for exemplary purposes only and all alternate constructions which are evident from this disclosure are, intended to be encompassed within the scope of the present invention.

In FIGS. 1 and 2, one embodiment of fast heating hair curler assembly 16 is depicted incorporating housing 17 which consists of base 18 and pivotable lid 19. As depicted, in this embodiment, a plurality of fast heating hair curler/rollers 20 are contained, mounted on a plurality of elongated, longitudinally extending, heat delivery rails 21. In this embodiment, each of the fast heating hair curlers/rollers 20 are constructed for being positioned and retained on rails 21 in a manner which enables each curler/roller to be mounted with a central axis substantially perpendicular to the elongated length of rail 21. In this way, fast heating hair curlers/rollers 20 are positioned in a vertically aligned, side-to-side relationship with each other, with the maximum number of rollers 20 being mountable on each rail 21, for a given length of rail 21.

By referring to FIG. 3, along with the following detailed discussion, the preferred construction for each heat delivering rail 21 can best be understood. As depicted therein, each heat delivering rail 21 comprises an elongated support panel 22 which incorporates opposed outer surfaces 24 and 25. In order to provide the desired vehicle for delivering heat to this assembly, heating wire 23 is wrapped about support panel 22, peripherally surrounding the entire length of outer surfaces 24 and 25. As depicted, in the preferred construction, heating wire 23 extends the entire length of support panel 22. In addition, in order to further enhance and improve the heat delivery capabilities of rail 21, elongated plate member 26 is placed in juxtaposed, overlying relationship with surface 24 of panel 22, while elongated plate number 27 is placed in juxtaposed, overlying relationship with surface 25.

In this way, support panel 22 and heating wire 23 are fully surrounded and protected by plates 26 and 27. In order to assure the desired rapid transfer of heat from wire 23, panels 22, 26, and 27 are all preferably formed from mica board in order to provide a construction capable of resisting any degradation from the heat produced by wire 23, as well as provide the desired heat transfer and delivery.

In completing the preferred construction of heat delivery rails 21 and providing the desired elongated, fast heating hair curler/roller supporting rail formed thereby, panels 24 and 25 are peripherally surrounded by layer 28 of a metallic sheet material. In the preferred embodiment, metallic sheet layer 28 comprises a generally inverted, elongated U-shape, which effectively peripherally surrounds and encloses the outer surfaces of panels 26 and 27, and the elongated top edges thereof. In this way, the entire exposed surface of the elongated roller-engaging heat delivery rail 21 effectively comprises an outer metallic covering, which assures the desired rapid transfer of heat to curlers/rollers 20 mounted thereon.

In its preferred construction, metallic sheet layer 28 comprises a plurality of arcuately curved embossed zones 29 formed thereon. As depicted, embossed zones 29 longitudinally extend in a substantially vertical direction, in juxtaposed, spaced, parallel relationship with each other. As is more fully detailed below, embossed zones 29 are constructed for engaging a similarly arcuately curved portion of each curler/roller 20, providing secure engagement therewith as well as direct contact with curler/roller 20 for providing optimum heat transfer.

In FIGS. 4 and 5, one preferred embodiment of hair curler/roller 20 is depicted. In this embodiment, hair curler/roller 20 comprises a substantially cylindrically shaped larger diameter tube member 35 within which slots 36 and 37 are formed in juxtaposed, spaced, aligned relationship with each other. As depicted, slots 36 and 37 extend longitudinally along a majority of the overall axial length of tube member 35.

In addition, hair curler/roller 20 comprises a cylindrically shaped small diameter, inner tube member 38 which extends the entire length of hair curler/roller 20, coaxially aligned with a large diameter tube member 35. As illustrated in FIGS. 4 and 5, the inner cylindrically shaped tube member 38 and the outer cylindrically shaped tube member 35 are free from direct contact along their entire lengths. Rather, a plurality of radially extending fins or wall portions 39 are contained within hair curler/roller 20 and extend between the inner cylindrically shaped tube member 38, and the outer cylindrically shaped tube member 35. As seen in FIGS. 4 and 5, the fins 39 are in direct contact with both the inner cylindrically shaped tube member 38 and the outer cylindrically shaped tube member 35. Moreover, each of the fins 39 has a length that is substantially equal to the lengths of the inner cylindrically shaped tube member 38 and the outer cylindrically shaped tube member 35.

As shown in FIG. 5, tube member 38 incorporates elongated slot 41 and 42 formed therein in juxtaposed, spaced, cooperating relationship with each other, as well as with slots 37 and 37. In this way, a diametrically extending, rail engaging passageway is formed in hair curler/roller 20, enabling hair curler/roller 20 to be quickly and easily positioned directly on heat delivery rail 21 in overlying, contacting engagement with embossed zone 29 formed thereon. By providing direct contact between embossed zones 29 and cylindrically shaped inner tube member 38, the desired direct contact and heat transfer between heat delivery rail 21 and hair curler/roller 20 is provided.

By employing this construction, optimum heat delivery from heat delivery system 21 to hair curler/roller 20 is achieved, with hair curler/roller 20 being constructed in a manner which enables the heat generated by heat delivery rail 21 to be absorbed by cylindrical tube member 38 and delivered rapidly and directly to radially extending fins 39. In addition, the heat absorbed by fins 39 is then rapidly transferred to large diameter, cylindrically shaped tube member 35, thereby assuring rapid heating of hair curler/roller 20 in its entirety.

In addition, the preferred construction of this embodiment of hair curler/roller 20 is capable of being manufactured by conventional extrusion equipment, typically from aluminum, thereby enabling the creation of hair curler/roller 20 in a comparatively inexpensive and rapidly produced manner. Furthermore, any additional manufacturing required to produce a final hair curler/roller 20 are also achieved in a fully automated, rapidly manufactured manner. As a result, hair curler/roller 20 is produced economically, thereby providing cost saving benefits to the consumer.

Finally, this embodiment of hair curler/roller 20 may be constructed, if desired, with any desired surface treatment being applied to tube member 35 of hair curler/roller 20. Such surface treatments include felt, rubber, plastic, or other desired materials which are commonly applied to the outer surface of hair curler/rollers for added convenience and comfort. As a result, any such desired surface treatment can be easily applied to hair curler/roller 20 of the present invention with equal efficacy.

In FIG. 6, an alternate preferred embodiment of hair curler/roller 20 is depicted which is constructed for being mounted to heat delivery rail 21 with the central axis of hair curler/roller 20 being substantially perpendicular to the longitudinal length of rail 21. In this embodiment, hair curler/roller 20 comprises a substantially cylindrically shaped tube member 35 forming the outer surface thereof, with slots 36 and 37 formed therein. As depicted, slots 36 and 37 are formed in juxtaposed, space, aligned relationship with each other, extending longitudinally along a majority of the overall length of tube member 35.

In this embodiment, hair curler/roller 20 comprises two arcuately curved wall members 45 and 46 which extend the entire length of tube member 35 and are positioned in juxtaposed, facing, cooperating relationship with each other. In addition, each wall member of 45 and 46 incorporates radially extending fins 47 and 48 interconnecting wall members 45 and 46 with tube member 35. By employing this construction, optimum heat delivery is realized with the heat generated by heat delivery rail 21 being quickly transferred to wall members 45 and 46 and carried from wall members 45 and 46 through fins 47 and 48 to tube member 35. As a result, the entire hair curler/roller 20 is quickly heated to the desired temperature for use.

Furthermore, this embodiment of hair curler/roller 20 is also capable of being manufactured by conventional extrusion equipment, typically from aluminum, thereby enabling the creation of hair curler/roller 20 in a comparatively inexpensive and rapidly produced manner. Furthermore, any additional manufacturing required to produce the final configuration of hair curler/roller 20 is also achieved in a fully automated, rapidly manufactured manner. As a result, this embodiment of hair curler/roller 20 is also produced economically, providing cost-saving benefits to the consumer.

Finally, if desired, this embodiment of hair curler/roller 20 may be constructed with any desired surface treatment being applied to tube member 35 of hair curler/roller 20. As discussed above, the surface treatments typically include felt, rubber, plastic, or other desired materials which are commonly applied to the outer surface of hair curler/rollers for added convenience and comfort.

By referring to FIGS. 7-10, along with the following detailed discussion, the construction and operation of the second preferred embodiment of the present invention can best be understood. In this embodiment, hair curler/roller 20 is constructed for mounting to heat delivery rail 21. In constructing this embodiment of heat delivery rail 21, the virtually identical construction details provided above and clearly shown in FIG. 3 are employed. Consequently, these details are incorporated herein by reference without further explanation, except for the elimination of embossed zones 29 in this embodiment.

Although heat delivery rail 21 is virtually identical in both embodiments, it is immediately apparent that hair curler/roller 20 is constructed in a dramatically different form than hair curler/roller 20 of the previous embodiment. In this embodiment, as with the embodiment detailed above, hair curler/roller 20 comprises substantially cylindrically shaped, outer tube member 35 and a plurality of radially extending; fins 39, each of which extend inwardly from the inside of tuber member 35. However, in this embodiment, hair curler/roller 20 comprises a single, elongated, longitudinally extending slot 50, which is formed by juxtaposed, spaced, facing wall members 51 and 52.

As a depicted, wall members 51 and 52 extend the entire axial length of hair curler/roller 20, extending inwardly from the outer surface of tube member 35. In the preferred embodiment, wall members 51 and 52 are each connected to the outer surface of tube member 35 and extend the entire axial length of tube member 35 defining an opening on slot 50 in tube member 35. In addition, wall members 51 and 52 comprise a width which is greater than the radius of hair curler/roller 20. By employing this construction, with wall members 51 and 52 extending the entire length of hair curler/roller 20, wall members 51 and 52 are positioned in aligned, juxtaposed, spaced, facing relationship to each other, with the spaced distance therebetween forming elongated, longitudinally extending slot 50 in tube member 35.

In addition, slot 50 is dimensioned to comprise an overall width slightly greater than the width of heat delivery rail 21. As a result, this embodiment of hair curler/roller 20 is able to be quickly and easily mounted to heat delivery rail 21 by merely positioning hair curler/roller 20 in longitudinally extending, mounted engagement on a length of heat delivery rail 21. By placing each additional hair curler/roller 20 on heat delivery rail 21 in a substantially similar manner, in spaced relationship to each other, any desired quantity of hair curler/roller 20 can be placed on heat delivery system 21 to attain the desired heating effect.

Figure 8:
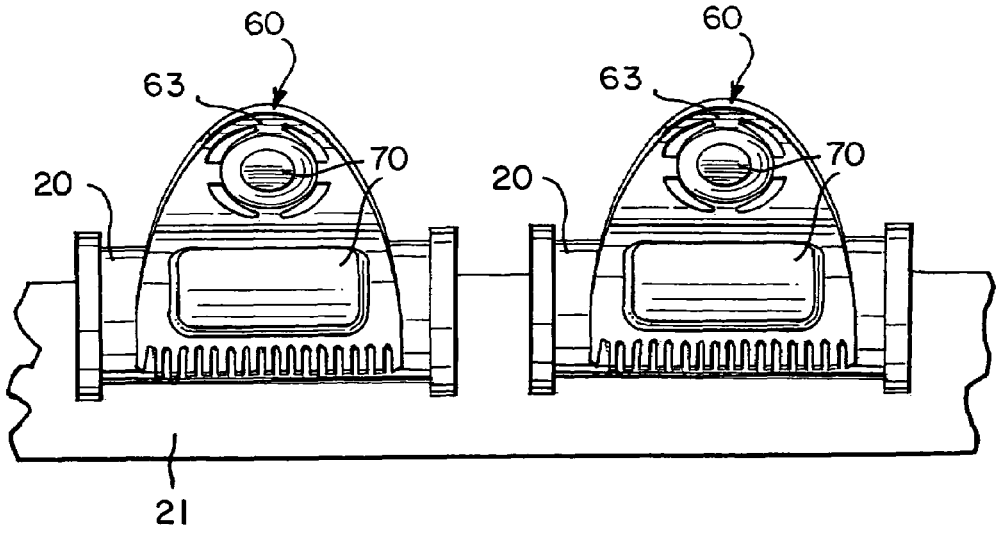
FIG. 8 is a perspective view of the hair curler/roller and hair clip of FIG. 7 mounted to the heat delivery system.

As is evident from the construction of this embodiment of hair curler/roller 20, substantially the entire hair curler/roller construction is placed directly on heat delivery rail 21, for receiving the heat generated thereby, as shown in FIG. 8. With wall members 51 and 52 in direct contact with heat delivery rail 21, along with fins 39 radially extending from wall members 51 and 52 to cylindrical tube member 35, the heat generated by heat delivery rail 21 is quickly transferred directly to wall members 51 and 52, through fins 39, and to tube member 35. In this way, this embodiment optimizes the direct contact of hair curler/roller 20 with heat delivery rail 21, thereby achieving a hair curler/roller 20 which is capable of being quickly heated to any desired temperature level.

A further advantage achieved with this embodiment of the present invention is the ability to thoroughly and completely heat any hair fastening clips 60 which are employed with hair curler/rollers 20. As depicted, hair fastening clip 60 comprises a generally conventional, spring-biased butterfly construction which enables arcuately curved finger portion 61 and 62 to be arcuately pivoted away from each other by pressing flanges 63 and 64 towards each other. When the pressure is removed, clip 60 returns to its original position, due to the spring member incorporated therein. In this way, hair clip 60 can be easily mounted onto hair curler/roller 20 as well as removed therefrom.

In the preferred embodiment, during the heating of hair curler/roller 20, hair clip 60 is mounted to hair curler/roller 20, as shown in FIG. 8. In this way, during the heating of hair curler/roller 20, hair fastening clip 60 is also heated by absorbing heat directly through tube member 35.

In order to attain the desired result, finger portion. 61 and 62 are preferably formed from material such as metal, which will absorb and retain heat. In this way, the desired elevated temperature can be imparted to clip 60. Furthermore, in order to allow clips 60 to be easily handled, zones 70 are formed on clips 60 with heat resistant material, enabling the user to easily grasp and use heated clips 60 without discomfort.

As a result, hair curler/roller 20 and hair fastening clip 60 are quickly and easily heated to any desired temperature. Once the heating cycle has been completed, hair fastening clip 60 and hair curler/roller 20 are removed from heat delivery rail 21 and positioned in the desired location on the hair fibers of the user.

By employing either embodiment of the present invention detailed herein, a user is able to achieve a rapidly heated hair curler/roller which is capable of being easily employed for rapidly absorbing heat from heat delivery rail 21. Once hair curler/roller 20 has been heated to the desired level, the hair curler/roller is removal from heat delivery rail 21 and used in the conventional manner. If the embodiment employing hair fastening clips 60 is employed, the heated hair clip 60 is also used in a generally conventional manner, further improving and enhancing the heat being delivered to the rolled hair fibers on the hair curler/roller of the present invention.

Figure 9:
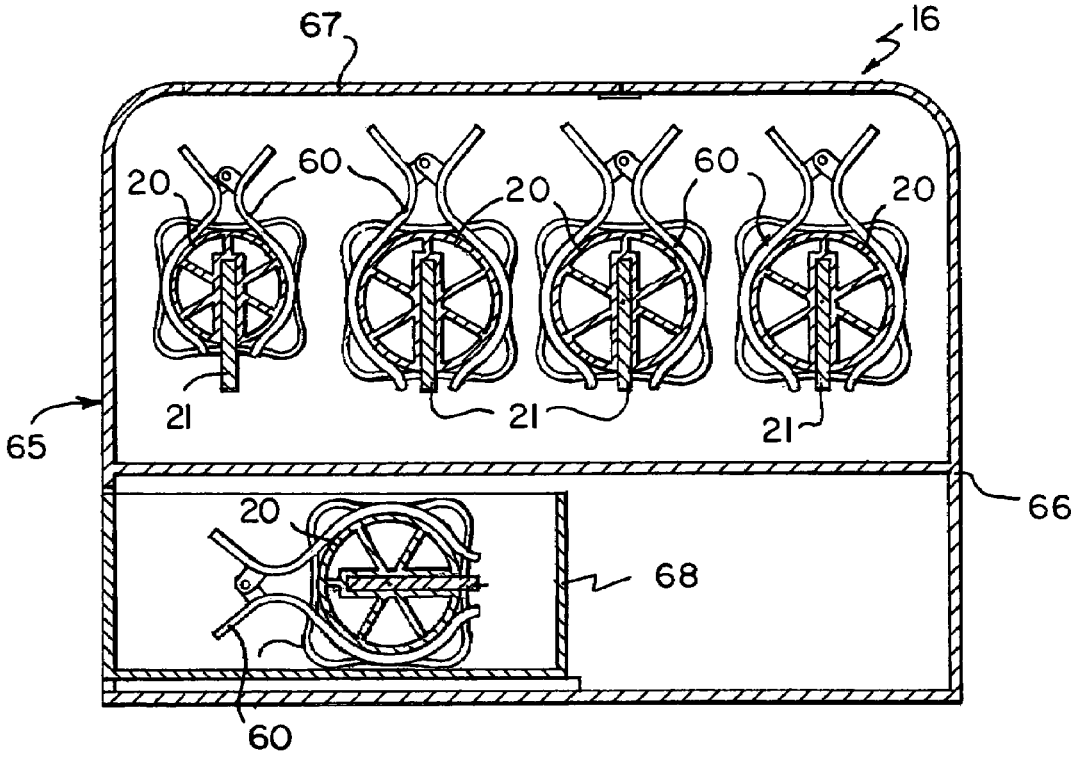
FIG. 9 is a cross-sectional side elevation view of a fast heating hair curler assembly of the present invention for use with the hair curler/rollers of FIG. 7.
Figure 10:
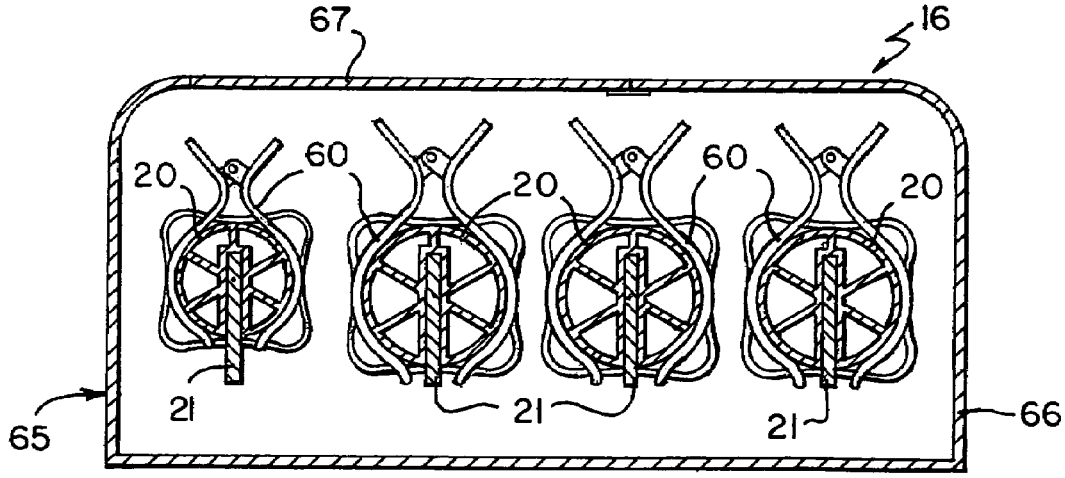
FIG. 10 is a cross-sectional side elevation view of another embodiment of a fast heating hair curler assembly of the present invention for use with the hair curler/roller of FIG. 7.

In FIGS. 9 and 10, two alternate constructions are depicted of a fully completed, fast heat hair curler/roller assembly 16 which employs the embodiment of hair curler/roller 20 with hair clips 60. As depicted, both of these embodiments of fast heating hair curler/roller assembly 16 incorporates housing 65 which comprises base 66 and lid 67. As shown, a plurality of longitudinally extending heat delivery rails 21 are mounted in base 66 with hair curler/rollers 20 and clips 60 positioned thereon for being heated in the manner detailed above.

As fully discussed above, in this embodiment, each hair curler/roller 20 longitudinally extends on heat delivery rails 21 with the central axis of hair curler/roller 20 being parallel to the longitudinal length of heat delivery rails 21. In this manner, a plurality of hair curler/rollers 20 are mounted in a longitudinally extending, side to side relationship with each other.

Although both embodiments of housing 65, depicted in FIGS. 9 and 10, are substantially equivalent in operation and functional capabilities, the embodiment of housing 65 depicted in FIG. 9 comprises a movable drawer 68 formed therein for enabling hair curler/rollers 20 and clips 60 to be stored, when not in use. In this way, additional rollers can be purchased with different diameters for different hair styles, with the additional rollers and clips being easily stored in housing 65 for use whenever desired. As a result, consumers are able to enjoy added convenience as well as a broader applicability and usability of fast heating hair curler/roller assembly 16 of the present invention.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention while we claim as new and desire to Secure by Letters Patent is:

1. A hair curler assembly comprising:

A. a housing;

B. a plurality of heat producing rails mounted in the housing, each of said rails comprising:

a) an elongate carrier on which a heating element is mounted, b) a pair of elongate panel members mounted to the carrier on opposed surfaces thereof, and c) a plate member peripherally surrounding the panel members and establishing the outer surface of the rail; and C. a plurality of hair curlers, each of said hair curlers comprising a central body formed from heat absorbing material and defining a mounting slot in the central body, said mounting slot enabling the curler to be mounted directly on the heat producing rail, the central body comprising an outer cylindrically shaped member, an inner member, and a plurality of fins connecting the inner member to the outer cylindrically shaped member, the fins being in direct contact with both the inner member and the outer cylindrically shaped member.

2. The hair curler assembly defined in claim 1, wherein the mounting slot extends longitudinally along the entire length of the curler for enabling the curler to be mounted to one of the heat producing rails with the longitudinal axis of the curler being parallel to a longitudinal axis of the rail.

3. The hair curler assembly defined in claim 2, wherein said assembly is further defined as comprising a hair retaining clip constructed for being removably mounted to the hair curler in peripherally surrounding engagement therewith for retaining hair wound on the hair curler.

4. The hair curler assembly defined in claim 3, wherein said hair retaining clip is further defined as being constructed from metal.

5. The hair curler assembly defined in claim 2, wherein the central body is an aluminum extrusion.

6. The hair curler assembly defined in claim 5, wherein the inner member of said central body comprises a pair of elongate, juxtaposed, spaced, facing panel members, said panel members extending longitudinally along a central axis of the outer cylindrically shaped member and extending radially into engagement with the cylindrically shaped member, said panel members defining at least part of said mounting slot.

7. The hair curler assembly defined in claim 6, wherein said panel members extend the entire length of the central body of the hair curler and comprise substantially flat surfaces.

8. The hair curler assembly defined in claim 1, wherein said central body further comprises a soft, non-heat absorbing layer of material about the outer surface of the outer cylindrically shaped member.

9. The hair curler assembly defined in claim 8, wherein said non-heat absorbing layer comprises a material selected from the group consisting of felt, rubber, and plastic.

10. The hair curler assembly defined in claim 1, wherein the mounting slot extends along a diameter of the central body and inwardly from one end of the central body for enabling the hair curler to be mounted to the heating rail so that a central axis of the hair curler is perpendicular to a longitudinally extending axis of the rail.

11. The hair curler assembly defined in claim 1, wherein the inner member of the central body is an inner cylindrically shaped member coaxially aligned with the outer cylindrically shaped member.

12. The hair curler assembly defined in claim 1, wherein the plate members peripherally surrounding the panel members of the heat producing rails comprises a plurality of rounded, outwardly extending, bossed areas transversely extending along the length of the rail member in juxtaposed, spaced relationship to each other, the bossed areas defining an engagement zone for receiving and contacting the inside surface of the inner member of the central body.

13. The hair curler assembly defined in claim 1, wherein said housing comprises a base in which the plurality of heat producing rails are mounted in parallel relationship with each other, and a lid pivotally mounted to the housing for opening and closing the housing.

14. A hair curler constructed for being mounted on an elongate heat producing rail, said curler comprising a central body formed from heat absorbing material, said central body comprising an outer cylindrically shaped tubular member forming the outer surface of the central body, a pair of arcuately curved wall members positioned within the tubular member in juxtaposed facing relationship with each other, and fins extending radially between one of the respective wall members and the tubular member to connect the wall members to the tubular member, the tubular member having a length and each of the fins having a length that is substantially equal to the length of the tubular member, the central body defining a mounting slot in the tubular member of the central body extending along a diameter of the tubular member and extending from one axial end thereof inwardly so the hair curler can be mounted on the heating rail with the central axis of the hair curler being perpendicular to the rail.

15. The hair curler defined in claim 14, wherein the pair of arcuately curved wall members extend substantially all the way between opposite ends of the tubular member.

16. The hair curler defined in claim 15, wherein the central body comprises a soft, non-heat absorbing layer of material about the outer surface of the cylindrically shaped member.

17. The hair curler defined in claim 16, wherein the central body is an aluminum extrusion.

18. The hair curler defined in claim 15, wherein the pair of arcuately curved wall members constitute an inner cylindrically shaped tubular member coaxially aligned with the outer tubular member.

19. A hair curler constructed for being mounted on an elongate heat producing rail, said curler comprising a central body made from a heat absorbing material, said central body comprising an outer cylindrically shaped member having a length and a first diameter, and an inner cylindrically shaped member having a length and a second diameter less than the first diameter, the inner cylindrically shaped member being coaxially aligned with the outer cylindrically shaped member, and a plurality of radially extending fins connecting the inner cylindrically shaped member to the outer cylindrically shaped member, the inner and outer cylindrically shaped members being free from direct contact along their entire lengths, the central body defining a mounting slot in the outer cylindrical member along a diameter thereof and extending from one end thereof inwardly so the hair curler can be mounted to a heating rail with the central axis of the hair curler being perpendicular to the rail.

20. The hair curler as set forth in claim 19 wherein the fins are in direct contact with the outer cylindrically shaped member.

21. The hair curler as set forth in claim 19 wherein the fins have a length that is substantially equal to the length of the outer cylindrically shaped member.

22. The hair curler as set forth in claim 21 wherein the length of the inner cylindrically shaped member is substantially equal to the lengths of the fins and the outer cylindrically shaped member.

* * * * *